US006364968B1

(12) United States Patent
Yasuhara et al.

(10) Patent No.: US 6,364,968 B1
(45) Date of Patent: Apr. 2, 2002

(54) HIGH-STRENGTH HOT-ROLLED STEEL SHEET HAVING EXCELLENT STRETCH FLANGEABILITY, AND METHOD OF PRODUCING THE SAME

(75) Inventors: Eiko Yasuhara; Akio Tosaka; Osamu Furukimi; Takao Uchiyama; Nobuo Yamada, all of Chiba (JP)

(73) Assignee: Kawasaki Steel Corporation (JP)

( * ) Notice: Subject to any disclaimer, the term of this patent is extended or adjusted under 35 U.S.C. 154(b) by 0 days.

(21) Appl. No.: 09/586,421

(22) Filed: Jun. 2, 2000

(51) Int. Cl.[7] ..... C22C 38/14; C22C 38/12; C21D 8/02

(52) U.S. Cl. ..... 148/320; 148/330; 148/333; 148/334; 148/335; 148/336; 148/602; 148/654

(58) Field of Search ..... 148/320, 330, 148/333–336, 602, 654

(56) References Cited

U.S. PATENT DOCUMENTS 4,316,753 A * 2/1982 Kankeko et al. ..... 148/333

OTHER PUBLICATIONS

Derwent publication of Japanese patent abstract 60184630A, Sep. 20, 1985.*

* cited by examiner

*Primary Examiner*—Deborah Yee

(74) *Attorney, Agent, or Firm*—Schnader Harrison Segal & Lewis LLP

(57) ABSTRACT

The invention provides a thin high-strength hot-rolled steel sheet with a thickness of not more than 3.5 mm which has excellent stretch flangeability and high uniformity in both shape and mechanical properties of the steel sheet, as well as a method of producing the hot-rolled steel sheet. A slab containing C: 0.05–0.30 wt %, Si: 0.03–1.0 wt %, Mn: 1.5–3.5 wt %, P: not more than 0.02 wt %, S: not more than 0.005 wt %, Al: not more than 0.150 wt %, N: not more than 0.0200 wt %, and one or two of Nb: 0.003–0.20 wt % and Ti: 0.005–0.20 wt % is heated at a temperature of not higher than 1200° C. The slab is hot-rolled at a finish rolling end temperature of not lower than 800° C., preferably at a finish rolling start temperature of 950–1050° C. A hot-rolled sheet is started to be cooled within two seconds after the end of the rolling, and then continuously cooled down to a coiling temperature at a cooling rate of 20–150° C./sec. The hot-rolled sheet is coiled at a temperature of 300–550° C., preferably in excess of 400° C. A fine bainite structure is obtained in which the mean grain size is not greater than 3.0 μm, the aspect ratio is not more than 1.5, and preferably the maximum size of the major axis is not greater than 10 μm.

9 Claims, 2 Drawing Sheets

HIGH-STRENGTH HOT-ROLLED STEEL SHEET HAVING EXCELLENT STRETCH FLANGEABILITY, AND METHOD OF PRODUCING THE SAME

BACKGROUND OF THE INVENTION

1. Field of the Invention

This invention relates to a hot-rolled steel sheet for use as high-strength parts such as bumper parts and impact beams of motor vehicles and, more particularly, to a high-strength hot-rolled steel sheet having excellent stretch flangeability with a tensile strength TS of not less than about 780 MPa. The invention also relates to a method of producing the hot-rolled steel sheet.

2. Description of the Related Art

In a recent trend toward lighter weight vehicle bodies, attention has been focused on application of high-strength steel sheets to a wider range of vehicle parts. In particular, high-strength steel sheets exceeding 1000 MPa have been employed as bumper parts, impact beams, etc. which are used to suppress deformation of cabins or passenger compartments upon collision of vehicles. Those high-strength steel sheets are cold-rolled steel sheets produced through a cold rolling process except for steel plate having thicknesses in excess of 3.2 mm. The main reason is that, in the case of employing cold-rolled steel sheets, disorder in shape of the steel sheet can be relatively easily suppressed by in-furnace rolls during continuous annealing and a good product shape can be obtained.

On the other hand, it has hitherto been difficult to employ hot-rolled steel sheets as thin high-strength steel sheets having thickness of not more than 3.2 mm, especially not more than 3.0 mm. One major reason is that, in a cooling step after hot rolling, effective tensile forces cannot be imparted to the steel sheet and disorder in shape of the steel sheet cannot be suppressed as with cold-rolled steel sheets.

In addition to the above-mentioned disorder in shape of the steel sheet, another reason why hot-rolled steel sheets have not been practically used as thin high-strength steel sheets having thickness not more than the above value is that the hot-rolled steel sheet is disadvantageous in ensuring satisfactory mechanical properties. More specifically, the structure just subjected to hot rolling without undergoing cold rolling and annealing is generally difficult to make uniform and achieve a fine structure comparable to that obtainable in the case of structures undergoing cold rolling and annealing. With the poor structure, it is difficult to obtain superior workability represented by stretch flangeability (bending workability and barring (Hole Expanding) workability).

To improve stretch flangeability of high-tensile hot-rolled steel sheets, several proposals have been made in the past. For example, Japanese Unexamined Patent Publication Nos. 61-19733 and 62-196336 disclose that the bainite phase is superior as a microstructure in consideration of stretch flangeability. In other words, according to those Publications, stretch flangeability is improved when a component system comprising a simple C—Si—Mn system is subjected to accelerated cooling after hot rolling to thereby develop a structure mainly comprising bainite.

The steel sheets produced by the methods disclosed in the above-cited Japanese Unexamined Patent Publication Nos. 61-19733 and 62-196336 have excellent stretch flangeability relative to that of a steel sheet having the ferrite-martensite structure, etc., but the stretch flangeability is not sufficient to reach a level (TS×El≧15500 MPa·% and hole expanding ratio ≧150%) demanded today. Further, the disclosed related art is disadvantageous in that the structure is likely to change with a comparatively high sensitivity depending on variations in the cooling start time after hot rolling and the hot rolling conditions such as the cooling rate and, therefore, the mechanical properties tend to vary to a larger extent. Such a tendency is not compatible with continuous and automatic pressing to be implemented by automobile makers and so on.

Further, Japanese Unexamined Patent Publication No. 5-320773 discloses that the effect of improving the stretch flangeability is improved by specifying the contents of S, N and O which are apt to easily produce inclusions in steel, and by adding Ti, Nb to obtain a finer structure. According to this Publication, the tensile strength of not less than 100 kgf/mm$^2$ is satisfied by setting the coiling temperature after hot rolling to be not higher than 400° C., and the stretch flangeability is improved by controlling the total content of (S+N+O) to be not more than 100 ppm.

With the producing method disclosed in the above-cited Japanese Unexamined Patent Publication No. 5-320773, however, the coiling temperature of not higher than 400° C. is required to obtain the tensile strength of not less than 100 kgf/mm$^2$ and, at such a temperature level, the mechanical properties are easily susceptible to significant variations while being in the form of a coil. Although the above-cited Japanese Unexamined Patent Publication No. 5-320773 does not clearly describe the microstructure of a hot-rolled sheet obtained by the disclosed producing method, the microstructure is presumably bainite or martensite. Then, the above disadvantage is attributable to the fact that the tensile strength can be improved, but the microstructure varies significantly and so does the tensile strength correspondingly due to the effect of variations in the steel components, the cooling conditions after hot rolling, and the temperature distribution in a coil obtained after winding the hot-rolled sheet. Such variations in the material characteristic are not compatible with continuous and automatic pressing to be implemented by automobile makers and so on.

In addition, the above-cited Japanese Unexamined Patent Publication No. 5-320773 describes the necessity of controlling the steel components to improve stretch flangeability, but the concrete relationship between the microstructure, crystal grain size, etc. and the stretch flangeability is not disclosed at all. Also, nothing is disclosed with regard to finish rolling start temperature, and coiling temperature after hot rolling is only specified to obtain the required strength.

Meanwhile, as a means for achieving the high tensile strength without performing accelerated cooling after hot rolling, there is a method of adding elements capable of improving quench hardening, such as Cu, Ni, Cr and Mo, which have been conventionally employed in the field of steel plate.

However, the method of adding the quench-hardening improving elements, such as Cu, Ni, Cr and Mo, has the problems that the necessity of using a large amount of expensive alloy elements is disadvantageous from the cost-effective point of view and renders the scrap management complicated from the viewpoint of recycling the used materials.

Further, the above known method requires the alloy elements to be added in such an amount that the added elements become perfectly a martensite single-phase. If the amount of the added alloy elements is insufficient, the resulting structure would be a mixed structure of ferrite and martensite, or a structure partly containing perlite and bainite in small amounts. Therefore, satisfactory stretch flangeability is not easy to attain as intended.

As described above, it has been very difficult to produce a high-strength hot-rolled steel sheet which has the tensile strength of not less than 780 MPa, particularly in the range of 780–1300 MPa, has good stretch flangeability, high uniformity in shape and mechanical properties of the steel sheet, and has quality enough to stand in practical use over a wide range of thickness from thickness not more than 3.0 mm corresponding to a thin steel sheet to a thickness of more than 3.0 mm corresponding to a thick steel sheet that is produced as an ordinary hot-rolled steel sheet. Accordingly, there has been a strong demand for development of the technique for producing a hot-rolled steel sheet, which can succeed in overcoming the problems set forth above. From the viewpoint of reducing the cost of steel sheets, in particular, there has been demanded a technique of producing a hot-rolled steel sheet with a composition of low-alloy system containing alloy elements in amount as small as possible.

OBJECTS OF THE INVENTION

With the view of overcoming the above-mentioned problems encountered in the related art, an object of the present invention is to provide a thin high-strength hot-rolled steel sheet which has excellent stretch flangeability and high uniformity in both shape and mechanical properties of the steel sheet, and to provide a method of producing the hot-rolled steel sheet.

Another object of the present invention is to provide an inexpensive producing technique which can produce the high-strength hot-rolled steel sheet even with a thickness of not more than 3.5 mm and a composition of low-alloy system.

Still another object of the present invention is to provide the high-strength hot-rolled steel sheet having the tensile strength of not less than 780 MPa as a target value for one practical characteristic of the steel sheet.

SUMMARY OF THE INVENTION

To achieve the above objects, the inventors conducted intensive experiments and studies from the standpoints of steel components, producing conditions, etc.

As a result, the inventors discovered that, by producing hot-rolled steel sheets under combination of steel having a composition adjusted to a proper component range and proper hot rolling—cooling conditions, a uniform and fine structure mainly comprising bainite can be formed and good mechanical properties can be obtained with stability without using expensive alloy elements.

It was also found that, of the producing conditions, control of a cooling pattern after the hot rolling and the coiling temperature after the hot rolling are important to obtain a uniform and fine bainite structure. More specifically, in conventional cooling on a hot run table, attention has been focused only on an average cooling rate from the start of the cooling to the coiling, and no consideration has been paid to cooling rates at respective positions on the hot run table. Further, in steel having the composition according to the present invention, the γ-structure is transformed into a desired microstructure at the time of coiling after the cooling, whereby the steel is provided with required mechanical characteristics such as tensile strength. However, it has been conventional to control only an average temperature over the entire length of a hot-rolled sheet coil having a width of 70 cm–120 cm and a length of 300 m–900 m, or to control only the temperature of the coil in its outer peripheral portion. Thus, the temperature of the hot-rolled sheet under coiling in the transverse direction and the temperature of the inside of the coil have not been controlled.

With those conventional methods, therefore, the shape and mechanical characteristics of the steel sheet are varied significantly due to variations in microstructure of the coiled steel sheet in the transverse and longitudinal directions, and the steel sheet having uniform mechanical properties enough to stand in practical use has not been obtained.

The inventors found that, to overcome the above-mentioned problem, it is very effective to continuously cool the hot-rolled steel sheet on the hot run table without interruption while holding a predetermined cooling rate (comparatively slow cooling) during cooling until the start of coiling after hot rolling, and to control the coiling temperature to fall in a proper range. Then, the inventors reached the conclusion that the above objects can be achieved by combining a proper steel composition with proper hot rolling conditions (such as a slab heating temperature and a finish rolling start temperature).

The present invention has been accomplished on the basis of the above findings and has the following features.

(1) In a high-strength hot-rolled steel sheet having excellent stretch flangeability, the steel sheet has a composition containing:

C: about 0.05–0.30 wt %,

Si: about 0.03–1.0 wt %,

Mn: about 1.5–3.5 wt %,

P: not more than about 0.02 wt %,

S: not more than about 0.005 wt %,

Al: not more than about 0.150 wt %,

N: not more than about 0.0200 wt %, one or two of Nb: about 0.003–0.20 wt % and Ti: about 0.005–0.20 wt %, B: about 0.0005–0.0040 wt % as an optionally added element, one or more of Cu: about 0.02–1.0 wt %, Ni: about 0.02–1.0 wt %, Cr: about 0.02–1.0 wt %, and Mo: about 0.02–1.0 wt %, as an optionally added elements, in total content of not more than about 1.0 wt %, Ca: about 0.0005–0.0050 wt % as an optionally added element, and the balance consisting of Fe and inevitable impurities, the steel sheet having a microstructure that contains fine bainite grains with a mean grain size of not greater than about 3.0 μm at an area percentage of not less than about 90%.

(2) In the high-strength hot-rolled steel sheet having excellent stretch flangeability as recited in paragraph (1), an aspect ratio of the fine bainite grains is not more than about 1.5.

(3) In the high-strength hot-rolled steel sheet having excellent stretch flangeability as recited in any of paragraphs (1) and (2), a maximum size of the major axis (usually in the rolling direction) of the fine bainite grains is not greater than about 10 μm.

(4) In a method of producing a high-strength hot-rolled steel sheet having excellent stretch flangeability, the method comprises the steps of preparing a slab containing C: about 0.05–0.30 wt %, Si: about 0.03–1.0 wt %, Mn: about 1.5–3.5 wt %, P: not more than about 0.02 wt %, S: not more than about 0.005 wt %, Al: not more than about 0.150 wt %, N: not more than about 0.0200 wt %, and one or two of Nb: about 0.003–0.20 wt % and Ti: about 0.005–0.20 wt %; heating the slab at a temperature of not higher than about 1200° C.; hot rolling the slab at a finish rolling end temperature of not lower than about 800° C., preferably at a finish rolling start temperature of about 950–1050° C.; starting to cool a hot-rolled sheet within about two seconds after the end of the rolling step; continuously cooling the hot-rolled sheet down to a coiling temperature at a cooling rate of about 20–150° C./sec; and coiling the hot-rolled sheet at a temperature of about 300–550° C., preferably in excess of 400° C.

Details of the present invention will be apparent from the Description of the Preferred Embodiments, Brief Description of the Drawings, and Examples given below.

Additionally, it is to be noted that the invention is not limited by Description of the Preferred Embodiments, Brief Description of the Drawings, and Examples given below.

DESCRIPTION OF THE PREFERRED EMBODIMENTS

Figure 1:
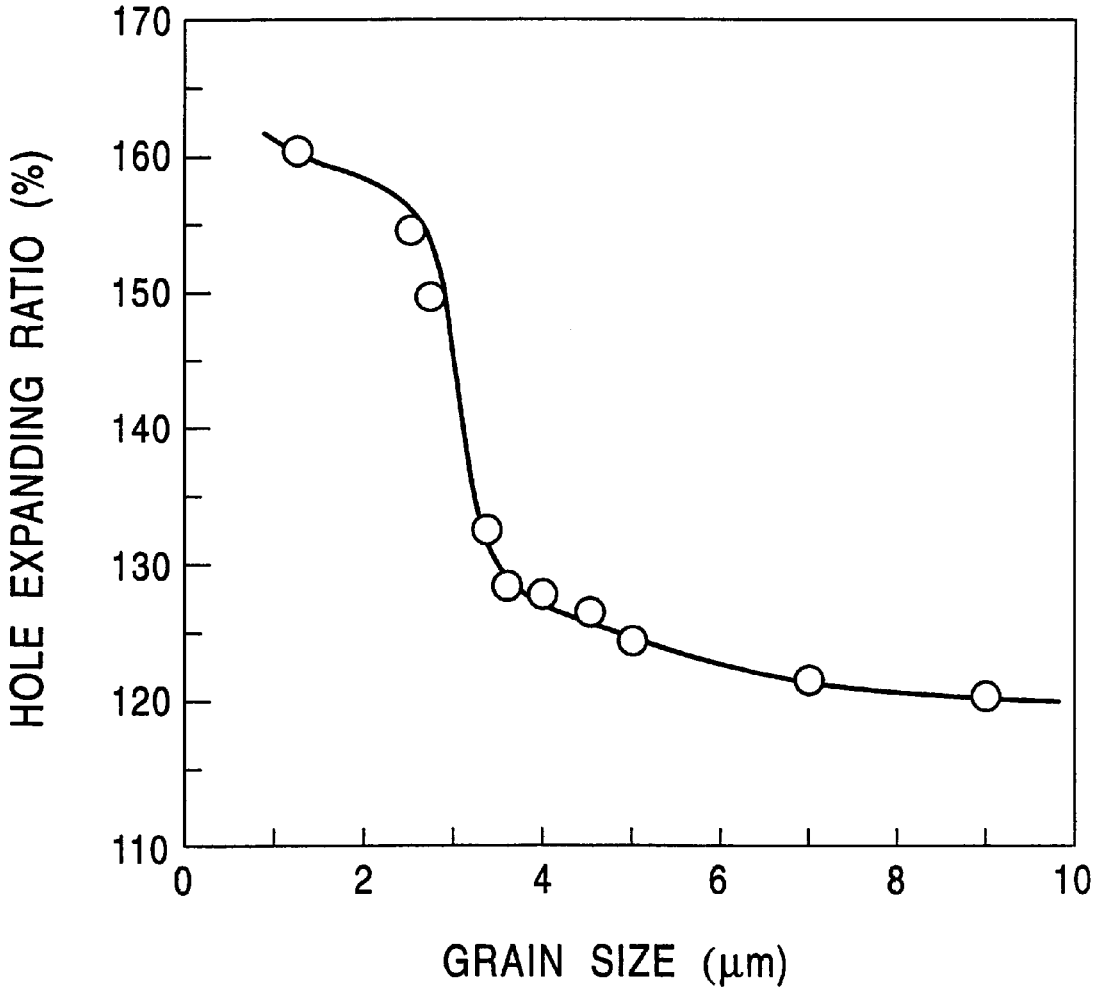
FIG. 1 is a graph showing the relationship between a grain size of bainite and a hole expanding ratio.

The invention is directed generally to a high-strength hot-rolled steel sheet having excellent stretch flangeability and a method of making such a steel sheet. More particularly, the invention provides a thin high-strength hot-rolled steel sheet with a thickness of not more than about 3.5 mm which has excellent stretch flangeability and high uniformity in both shape and mechanical properties of the steel sheet, as well as a method of producing the hot-rolled steel sheet. A slab containing C: 0.05–0.30 wt %, Si: 0.03–1.0 wt %, Mn: 1.5–3.5 wt %, P: not more than 0.02 wt %, S: not more than 0.005 wt %, Al: not more than 0.150 wt %, N: not more than 0.0200 wt %, and one or two of Nb: 0.003–0.20 wt % and Ti: 0.005–0.20 wt % is heated at a temperature of not higher than about 1200° C. The slab is hot-rolled at a finish rolling end temperature of not lower than about 800° C., preferably at a finish rolling start temperature of about 950–1050° C. A hot-rolled sheet is started to be cooled within about two seconds after the end of the rolling, and then continuously cooled down to a coiling temperature at a cooling rate of about 20–150° C./sec. The hot-rolled sheet is coiled at a temperature of about 300–550° C., preferably in excess of 400° C. A fine bainite structure is obtained in which the mean grain size is not greater than about 3.0 $\mu$m, the aspect ratio is not more than about 1.5, and preferably the maximum size of the major axis is not greater than about 10 $\mu$m.

The reasons of restricting the contents of component elements as set forth above will be described below.

C: 0.05–0.30 wt %

C is an element effective to achieve strengthening by the transformed structure. The effect is developed by adding not less than about 0.05 wt % of this element. However, if the content exceeds about 0.30 wt %, the nugget formed by spot welding will be too hard, thus resulting in deterioration of weldability and difficulty when applied as steel sheets for use in motor vehicles. The C content is therefore restricted to the range of about 0.05–0.30 wt %. From the viewpoint of stability in mechanical properties of the steel sheet, the C content is preferably held in the range not more than about 0.20 wt %.

Si: 0.03–1.0 wt %

Si is an element useful to increase the tempering softening resistance when strengthening by the transformed structure is utilized. To that end, it is required to add this element in content not less than about 0.03 wt %, preferably not less than about 0.1 wt %. On the other hand, Si exhibits an action to increase the hot deformation resistance. If Si is added in excess of about 1.0 wt %, such an action will be especially notable and hot rolling into thin steel sheets intended by the invention will be difficult. The Si content should be, therefore, not more than about 1.0 wt %. In applications where scale-like defects (e.g., red scale and linear scale) on the surface must be avoided, the Si content is preferably suppressed to be not more than about 0.8 wt %.

Mn: 1.5–3.5 wt %

Mn is an element that is effective in preventing hot rolling cracks attributable to addition of S and is preferably added depending on the S content. Mn is also effective in forming finer crystal grains and, therefore, essential for the purpose of improving the mechanical properties as well. In the invention, particularly, the high strength of the steel is achieved with the Mn action of improving hardenability in a low-temperature transformed phase mainly comprising bainite, thereby ensuring the tensile strength TS of not less than about 780 MPa after being subjected to hot rolling. In order to develop the above effects, at least about 1.5 wt % of Mn must be added. With an increase in the content of Mn added, more stable strength is obtained and uniformity of the mechanical properties is improved.

However, if Mn is added in excess of about 3.5 wt %, not only the effects of Mn will be saturated, but also the hot deformation resistance will be increased to impose a difficulty in decreasing the thickness of the steel sheet by the hot rolling. Further, excessive addition of Mn will deteriorate weldability and formability of the weld. For those reasons, an upper limit of the content of Mn added is set to about 3.5%. In applications where better weldability and formability are required, the Mn content is preferably set to be in the range not more than about 3.2 wt %.

P: Not More Than 0.02 wt %

Generally, P may be added to a high-strength steel sheet having a two-phase structure of ferrite and perlite, which has a comparatively low strength, as an element for enhancing solid solution of the ferrite phase. In the steel sheet of the invention and having the tensile strength TS of not less than about 780 MPa, however, enhancement of solid solution by addition of P is not expected. Also, when the contents of C, Mn, and the like are large, addition of P acts to harden the steel sheet and deteriorates the stretch flangeability. Further, P has a strong tendency to segregate in a particular position of the steel sheet in the direction of the thickness thereof, and gives rise to embrittlement of the weld due to the segregation. For those reasons, the P content should be limited to be not more than about 0.02 wt %, preferably not more than about 0.01 wt %.

S: Not More Than 0.005 wt %

S is a detrimental element that is present in steel as an inclusion, reduces ductility of the steel sheet, and deteriorates corrosion resistance. In the high-strength steel sheet as intended by the present invention, particularly, since the notch sensitivity is increased, the amount of inclusions of MnS system, which may serve as stress concentrating sources, is required to be as small as possible. For that reason, the S content must be minimized and an upper limit of the S content is set to about 0.005 wt %. In applications where good workability is especially required, the upper limit of the S content is preferably set to about 0.002 wt %.

Al: Not More Than 0.150 wt %

Al is added as a dioxidizing element, and is an element useful for improving cleanliness of the steel and forming a finer structure. In order to develop those effects, adding Al in an amount not less than about 0.010 wt %, though depending on the deoxidizing technique applied to molten steel, is generally required. However, an excessive. Al content will deteriorate surface properties of the steel sheet and reduces the strength thereof. Accordingly, Al is added in content not more than about 0.150 wt %. From the viewpoint of stability of the mechanical properties, Al is preferably added in the range of about 0.010–0.080 wt %.

N: Not More Than 0.0200 wt %

If N is contained in excess of about 0.0200 wt %, hot ductility of steel will be lowered, internal defects and surface defects of the steel sheet will be more likely to occur, and the possibility of slab cracks during continuous casting will be increased. Accordingly, an upper limit of the N content is set to about 0.0200 wt %. From the viewpoints of improving stability of the mechanical properties and yield in consideration of the overall production process, the N content is preferably in the range of about 0.00200–0.0150 wt %. Since N exhibits an action to lower the transformation point of steel, adding N within the above range is effective when the temperature should be avoided from falling down to a large extent from the transformation point during the rolling in production of thin steel sheets.

Nb: 0.003–0.20 wt % and Ti: 0.005–0.20 wt %

These elements are very important elements that contribute to forming finer and more uniform structure. In the present invention, these elements enable the intended fine crystal structure not larger than about 3.0 $\mu$m to be achieved in combination with a comparatively low slab heating temperature. That effect can be obtained by adding at least not less than about 0.003 wt % of Nb or not less than about 0.005 wt % of Ti. If any of Nb and Ti is added in excess of about 0.20 wt %, not only the effects of these elements will be saturated, but also the risk of slab cracks during continuous casting will be increased. Accordingly, Nb is added in the range of about 0.003–0.20 wt % and Ti is added in the range of about 0.005–0.20 wt %.

Next, optionally added elements will be described.

B: 0.0005–0.0040 wt %

B effectively contributes to forming a finer structure of the steel sheet, and in addition is very effective in obtaining a high-strength steel sheet because it suppresses ferrite transformation of steel.

Those effects are developed by adding not less than about 0.0005 wt % of this element. On the other hand, even if B is added in excess of about 0.0040 wt %, the above effects will be saturated. Accordingly, B is added in the range of about 0.0005–0.0040 wt % as needed.

Cu: 0.02–1.0 wt %, Ni: 0.02–1.0 wt %, Cr: 0.02–1.0 wt %, Mo: 0.02–1.0 wt %, and Total Content of Not More Than 1.0 wt %

These elements are useful to delay transformation after the end of hot rolling so that strengthening by the transformed structure is effectively utilized and the strength of the steel sheet is increased. This effect can be obtained by adding not less than about 0.02 wt % of any of those elements. However, excessive addition will increase the deformation resistance during hot rolling, deteriorate the chemical treatment ability, more broadly speaking, the surface treatment ability, and reduce formability of the weld due to hardening of the weld. Accordingly, an upper limit of the content of these elements is set to about 1.0 wt % for each element and also to about 1.0 wt % for total content. All of these elements behave in a similar manner regardless of whether it is added either alone or in combination with one or more others.

Ca: 0.0005–0.0050 wt %

Ca is an element useful to make S in steel not detrimental. Particularly, in the fine structure that contains a relatively large amount of Mn and mainly comprises bainite, addition of Ca provides a remarkable improvement of the stretch flangeability. This effect is developed by adding not less than about 0.0005 wt % of Ca. However, if Ca is added in excess of about 0.0050 wt %, not only the effect will be saturated, but also the surface properties will rather deteriorate, thus resulting in the risk of impairing the surface treatment characteristics. Accordingly, the Ca content is set fall in the range of about 0.0005–0.0050 wt %. In consideration of balance among various mechanical properties, Ca is preferably added in the range of about 0.0010–0.0035 wt %.

Fine Bainite Structure

The microstructure in the invention is required to be a fine structure mainly comprising bainite such that an area percentage of bainite is not less than about 90% . Bainite and martensite not subjected to tempering can be made based on a difference in strength between them, but it is difficult to discriminate bainite from "tempered martensite". In the invention, therefore, they are discriminated by focusing attention on the precipitated state of carbides. Specifically, when carbides were mainly precipitated within grains or at the lath boundary, that structure was determined to be bainite. On the other hand, when carbides were also frequently precipitated at the old austenite grain boundary, that structure was determined to be "tempered martensite".

The relationship between the type of the structure and the stretch flangeability was studied on the basis of the above-described criteria for determining the structure. As a result, even with steel sheets having the same strength, one having the structure mainly comprising bainite exhibited much better stretch flangeability than the other. While we do not intend to be bound or limited to any particular theory, we believe the reason is that carbides precipitated at the old austenite grain boundary, especially coarse carbides, adversely affect the stretch flangeability.

Mean Grain Size and Aspect Ratio of Bainite Structure

The finer bainite structure provides better stretch flangeability. From this point of view, restricting the crystal grain size is also one of the important factors. The mean grain size of the bainite structure was calculated in accordance with the manner of measuring the mean grain size of ferrite (JIS (Japanese Industrial Standards) G0552). Specifically, the mean grain size of the bainite structure was determined by averaging all values of the grain sizes measured throughout the thickness at a section of each steel sheet in both the rolling direction and a direction perpendicular to the rolling direction.

When the mean grain size thus measured is not greater than about 3.0 $\mu$m, the stretch flangeability is noticeably improved. In conventional precipitation strengthened steel sheets, the bainite structure having the mean grain size of not greater than about 3.0 $\mu$m is partly obtained in some examples. However, those examples partly contain coarse structures, and the bainite structure having the mean grain size of not greater than about 3.0 $\mu$m throughout the thickness entirely has never been reported up to now. Further, the bainite structure is preferably free from grain mixing, i.e., free from the presence of coarse grains having grain sizes of greater than about 10 μm in terms of the major axis. In the case where better stretch flangeability is required, the mean grain size of the bainite structure is preferably not greater than about 2.5 μm. Additionally, the aspect ratio of bainite grains is preferably set to be not more than about 1.5 from the viewpoint of workability. Here, the aspect ratio means the ratio of the major axis to the minor axis of a bainite grain. The major axis corresponds substantially to the rolling direction, and the minor axis corresponds to the direction of thickness of the steel sheet.

FIG. 1 shows the relationship between stretch flange performance (hole expanding ratio) and the mean grain size of the bainite structure. Test specimens were hot-rolled steel sheets (tensile strength Ts: 790–1200 MPa) having a thickness of 2.8 mm, which were produced from steel slabs having a composition of C: 0.08 wt %, Si: 0.21wt %, Mn: 3.0wt %, Al: 0.040 wt %, N: 0.0030 wt %, Ti: 0.15 wt %, B: 0.0008 wt %, and Ca: 0.0020 wt %. Tests were conducted by widely changing the slab heating temperature over 950–1300° C., the finish rolling temperature over 750–980° C. and the cooling rate over 10–200° C./sec to thereby adjust the coiling temperature so that the area percentage of the bainite structure is not less than 90% . As seen from FIG. 1, the stretch flange performance (hole expanding ratio) is noticeably improved by setting the mean grain size of the bainite structure to be not greater than about 3.0 μm.

It was also confirmed that the stretch flange performance (hole expanding ratio) was not simply correlated with TS. Even with the same TS, the stretch flange performance (hole expanding ratio) can be improved by forming a finer structure.

Figure 2:
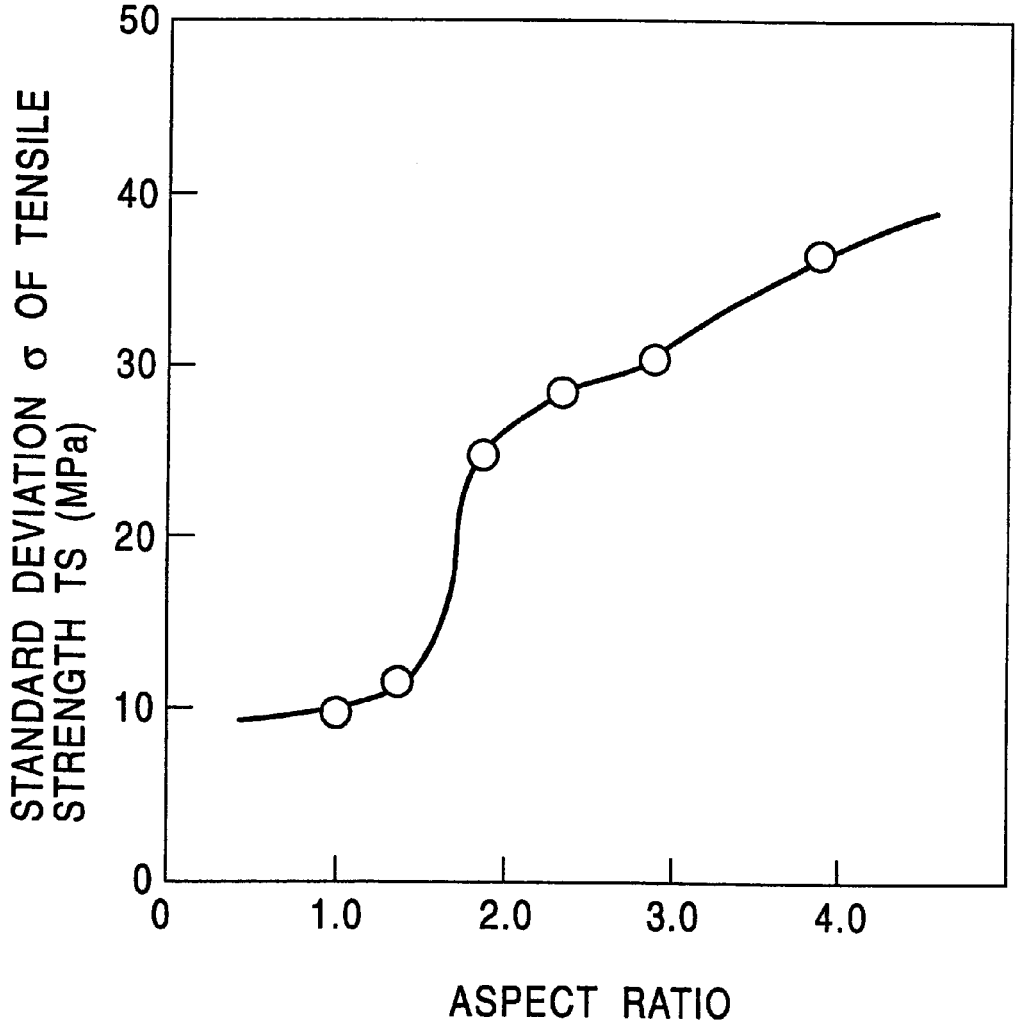
FIG. 2 is a graph showing the relationship between an aspect ratio of the bainite structure and a standard deviation of tensile strength in a coil.

FIG. 2 shows results of tests made for studying the relationship between the aspect ratio of the bainite structure and a standard deviation of tensile strength in a coil. Test specimens were hot-rolled steel sheets having a thickness of 2.3 mm, which were produced from steel slabs having a composition of C: 0.09 wt %, Si: 0.5 wt %, Mn: 2.4 wt %, S: 0.0008 wt %, Al: 0.04 wt %, N: 0.002 wt %, Nb: 0.012 wt %, Ti: 0.058 wt %, and Ca: 0.0015 wt %. Tests were conducted by changing the slab heating temperature over 1000–1300° C., the finish rolling temperature over 750–1100° C. and the cooling rate over 15–150° C./sec to thereby adjust the coiling temperature so that the area percentage of the bainite structure is not less than 90% . As seen from FIG. 2, a standard deviation of the tensile strength in the coil is decreased by setting the aspect ratio to be not more than about 1.5.

Incidentally, the vertical axis of FIG. 2 represents the standard deviation ay of the tensile strength TS measured for total 15 points on the steel sheet, i.e., 3 points in the longitudinal direction and 5 points in the transverse direction.

The hole enlargement test for determining the hole expanding ratio was made in conformity with the standards of the Japan Iron and Steel Federation. Thus, the test was conducted by punching a hole of 10 mmφ through the test specimen (constant clearance of 12.5% ) and enlarging the hole by a conical punch with an apical angle of 60°.

Next, production conditions will be described.

A slab is desirably produced by a continuous casting method from the viewpoint of preventing macroscopic segregation, but it may also be produced by the ingot-making method or the thin slab casting method.

The produced slab can be applied without problems to not only the conventional process of cooling down the slab to room temperature and then heating it again, but also other energy-saving processes, e.g., the direct-fed rolling process of inserting the slab in a hot state into a heating furnace and then rolling it, and the direct rolling process of rolling the slab immediately after holding the temperature for a while. From the viewpoints of obtaining the uniform and finer initial structure, however, it is desired to heat the slab again after completing the transformation from γ to α even when the direct-fed rolling process or the like is performed.

Slab Heating Temperature (SRT): 1200° C. or Below

The slab heating (reheating) temperature greatly affects the γ-grain size. When producing the high-strength steel sheets intended by the invention, which are added with elements forming carbides and nitrides, such as Nb and Ti, it has hitherto been general practice to bring these elements into a complete solid solution state as an initial state so that the precipitation strengthening is effectively utilized, and to set the SRT to temperatures higher than a level of 1250° C.

On the other hand, the inventors found that, even with the high-strength steel sheets containing Nb and Ti, part of the added Nb and Ti can be made to remain in a not solid solution state and uniformity and fineness of the hot-rolled structure can be significantly improved by restricting the SRT to be not higher than 1200° C. In the invention, the deformation resistance during hot rolling is more likely to increase than the conventional high-SRT method, but the extent by which the deformation resistance increases is comparatively small because the dynamic recrystallization takes place in a rough rolling step of the hot rolling process. Thus, in the invention, although the action of the precipitation strengthening by Nb (N, C) and TiC is reduced, remarkable advantages of improving uniformity and fineness of the structure are obtained. Also, such a reduction in the action of the precipitation strengthening can be compensated by the advantages resulted from forming the uniform and finer structure mainly comprising bainite. Additionally, to further improve uniformity and fineness of the structure, the SRT is set to be preferably not higher than 1100° C., more preferably not higher than 1050° C.

Finish Rolling Start Temperature (Entry Side Temperature of Finish Rolling Mill): 950–1050° C.

In the invention, an increase in the deformation resistance during finish rolling can be suppressed by causing the dynamic recrystallization to take place during rough rolling, and promoting the dynamic recrystallization during at least 1–4 passes of the finish rolling. Further, the dynamic recrystallization is effective in not only reducing the deformation resistance during the rolling, but also producing isometric grains so that the aspect ratio of bainite grains of not more than about 1.5 can be advantageously achieved. To promote the dynamic recrystallization during the finish rolling, the finish rolling start temperature is important. By setting the finish rolling start temperature to fall in the range of about 950–1050° C., the dynamic recrystallization is promoted and an increase in the deformation resistance can be suppressed.

Finish Rolling End Temperature (Delivery Side Temperature of Finish Rolling Mill): Not Lower Than 800° C.

By setting the hot finish rolling end temperature to be not lower than about 800° C., the hot-rolled steel sheet can be given the uniform and fine structure. However, if the finish rolling end temperature is lower than about 800° C., the structure of the steel sheet will be elongated to become not uniform and the work-affected structure will partly remain, thus increasing the risk that various failures may occur during forming. Accordingly, the finish rolling end temperature is set to be not lower than about 800° C. When a further improvement of the mechanical properties is required, the finish rolling end temperature is preferably set to be not lower than about 820° C. An upper limit of the finish rolling end temperature is not especially required to be set, but the finish rolling end temperature is usually not higher than about 950° C., taking into account the SRT.

Cooling After Hot Finish Rolling

In the invention, cooling after the hot finish rolling (after the steel sheet has come out of rolls of the final rolling mill) is continuously performed down to the coiling start temperature at the cooling rate of about 20–150° C./sec (the term "cooling rate" does not mean an average cooling rate, but an optimum cooling rate to be maintained on a hot run table at any point in time during the cooling process). The purpose of so controlling the cooling after the hot rolling is to finally obtain the uniform and fine bainite structure with stability. The invention achieves the above purpose by continuously forcibly cooling the hot-rolled steel sheet with cooling water from the delivery side of the finish rolling mill on the hot run table until reaching the coiling start temperature without interrupting the cooling midway unlike the related art. The cooling rate in the cooling process is set to fall in the range of about 20–150° C./sec throughout the entire temperature range until reaching the coiling start temperature. If the cooling rate is smaller than the above range, a satisfactory level of strength cannot be obtained. On the other hand, if the cooling rate is greater than the above range, variations in strength of the steel sheet in both the transverse and longitudinal directions will be increased.

Also, from the viewpoint of achieving uniformity of the mechanical properties and uniformity of the shape in a compatible manner, it is effective to start the cooling after the hot rolling with water cooling immediately after the steel sheet has come out of rolls of the final rolling mill, and to employ the so-called slow cooling where the coefficient of heat transfer is smaller than usual one.

If such cooling is not started within two seconds from the end of the hot rolling after the steel sheet has come out of rolls of the final rolling mill, work strains imposed by the rolling will be canceled, fineness of the structure will not be achieved at an effective level, and a non-uniform structure including a coarse structure mixed therein will result. For that reason, the cooling must start within two seconds from the end of the hot rolling. Further, when cooling the hot-rolled steel sheet with a thickness of not greater than about 3.5 mm, intended by the invention, on the hot run table, the coefficient of heat transfer during the cooling is preferably set to be not greater than about 1000 $W/m^2 \cdot K$. The coefficient of heat transfer during cooling is determined depending on the thickness, surface state and temperature of the steel sheet, the water flow rate (liter/min) during the cooling, and the water temperature. In particular, when the surface temperature of the steel sheet is lowered down below about 500° C., the boiling state of the steel sheet surface is changed and the coefficient of heat transfer is also changed correspondingly. If the coefficient of heat transfer during the cooling is greater than about 1000 $W/m^2 \cdot K$, the cooling rate of about 20–150° C./sec will be difficult to maintain throughout the entire steel sheet in both the longitudinal and transverse directions, thus resulting in disorder in shape of the steel sheet and deterioration in uniformity of the mechanical properties. Accordingly, the coefficient of heat transfer at temperatures of not higher than about 500° C. is preferably not greater than about 1000 $W/m^2 \cdot K$. Also, if the cooling rate is not uniform, this will cause disorder in shape of the steel sheet, make the cooling rate more non-uniform, and further deteriorate uniformity of the mechanical properties. Moreover, when cooling the hot-rolled steel sheet on the hot run table, both end portions of the steel sheet in the transverse direction may be masked so that the cooling water does not directly strike against the edge portions of the steel sheet, for the purpose of preventing excessive cooling of the edge portions of the steel sheet. By so masking both the end portions of the steel sheet against the cooling water, uniform cooling is achieved and the above-mentioned effect can be more noticeably developed.

Coiling Temperature: 300–550° C.

By stating to coil the hot-rolled steel sheet at temperatures not higher than about 550° C., the tensile strength of about 780 MPa can be satisfied in the intended bainite structure. However, if the coiling is started at temperatures lower than about 300° C., the martensite structure is also partly formed in addition to the bainite structure, thus resulting in non-uniformity of the structure and hence deterioration in uniformity of the mechanical properties. Also, since the shape of the steel sheet will be deteriorated, subsequent leveling of the shape will be difficult to implement and troubles may occur in practical use. Accordingly, the coiling temperature after the hot rolling is set to fall in the range of about 300–550° C. When higher uniformity of the mechanical properties is required, the coiling temperature is preferably set to be higher than about 400° C.

Furthermore, taking into account that the occurrence of catch troubles, flaws, and the like should be prevented in a later work line such as pressing, the steel sheet is preferably shaped to have a flatness with a wave height of not greater than about 25 mm. Incidentally, the wave height representing flatness is measured on a surface plate in conformity with the standards of the Japan Iron and Steel Federation.

The steel sheet of the invention can be produced through the processes satisfying the conditions described above. However, employing the following measures either alone or in a combined manner as assistant is desired from the viewpoints of further improving the sectional shape of the steel sheet, dimensional accuracy, uniformity of the mechanical properties, and the like.

The first measure is to join a preceding sheet and a succeeding sheet with each other on the entry side of the finish rolling mill for continuous rolling. By carrying out the continuous rolling in such a way, the so-called unsteady portions in rolling, which occur at the front and rear ends of each sheet to be rolled, are eliminated and stable hot rolling conditions can be achieved over the entire length and width of the steel sheet. The rolling under such stable conditions significantly contribute to improving the sectional shape of the steel sheet. Then, it is possible to obtain the good and stable shape of the steel sheet over the entire length on the hot run table, and to easily realize uniform cooling conditions through out the steel sheet in both the longitudinal and transverse directions. These results are advantageous in achieving the uniform and fine structure.

A method for joining successive sheets with each other on the entry side of the finish rolling mill is not particularly specified, but may be implemented by, for example, induction heating welding, pressure contacting welding, laser welding, and electron beam welding. By thus continuously rolling a preceding sheet and a succeeding sheet, tensile forces can always be applied to the steel sheet while the steel sheet after being subjected to the rolling is cooled on the hot run table, whereby the shape of the steel sheet can be held in a satisfactory state. In addition, non-uniformity of cooling attributable to the poor shape of the steel sheet can also be prevented.

Further, with the above continuous rolling method, since the leading end of a sheet to be rolled can be passed between rolls with stability, it is possible to implement hot rolling with a low coefficient of friction, i.e., hot rolling using a large amount of lubricant, which has been difficult to implement in usual single batch rolling from the viewpoints of threading and biting and, hence, to reduce the rolling load. Simultaneously, since the roll surface pressure can be reduced, the roll life is prolonged. Also, a reduction in the coefficient of friction during rolling is very effective in realizing a more uniform structure in the direction of thickness of the steel sheet.

As described above, in production of the thin hot-rolled steel sheet, joining a preceding sheet and a succeeding sheet with each other for continuous rolling is very effective.

As a second measure, using edge heaters on the entry side of the finish rolling mill to heat transverse end portions of a sheet to be rolled (i.e., a sheet bar) is effective to make the temperature of the sheet to be rolled uniform in the transverse direction. In the invention, since uniformity of the temperature of the steel sheet during both the rolling and the cooling on the hot run table is important, the transverse end portions of the steel sheet, in which the temperature is more apt to be lower, are preferably heated on the entry side of the finish rolling mill so that the temperature of the steel sheet is uniformly distributed in the transverse direction.

Further, the temperature is also apt to be lower in longitudinal end portions of the sheet to be rolled. Therefore, the longitudinal end portions of the sheet to be rolled (i.e., the sheet bar), in which the temperature is apt to be lower, is preferably heated by a heating device (hereinafter referred to as a sheet bar heater) capable of heating the sheet bar over its entire width so that the temperature of the sheet bar is uniformly distributed in the longitudinal direction. When joining successive sheet bars and rolling them, the sheet bar is sometimes coiled into the form of a coil on the entry side of a joining apparatus. In such a case, since the temperature is more apt to be lower in the outermost and innermost turns of the coil, it is particularly preferable to heat them by using the above-mentioned sheet bar heater.

The amount of heat applied for heating the sheet to be rolled by using the edge heaters and the sheet bar heater is recommended to satisfy such a condition that a temperature difference of the overall sheet in the final finish rolling is held not more than 20° C. This value of the temperature difference varies to some extent depending on the steel composition and other factors.

According to the method described above, the TS of not less than about 780 MPa and the good stretch flangeability can be uniformly given to a steel sheet in both the longitudinal and transverse directions. Also, since a steel sheet after the hot rolling is subjected to the slow cooling on the hot run table, a hot-rolled steel sheet being superior in sheet shape as well can be produced.

Further, by employing, in a combined manner, the continuous rolling method to perform finish rolling on a preceding sheet and a succeeding sheet after being joined to each other, and heating of a sheet bar with the edge heaters and/or the sheet bar heaters, uniformity of the mechanical properties can be further improved.

After the hot rolling, the steel sheet is sent to a subsequent step after removing an oxide layer on the sheet surface by pickling, and after being subjected to skin pass rolling for control of the surface roughness or to a leveler for leveling of the sheet shape. Alternatively, the hot-rolled steel sheet may also be used in the form of a black sheet with oxide films remaining thereon without being subjected to pickling. In addition, various surface coatings may be optionally formed on the steel sheet by electro-plating and hot dipping.

EXAMPLES

Example 1

A steel slab having a composition containing components listed in Table 1 and the balance consisting essentially of Fe was smelted. This steel slab was subjected to hot rolling under conditions shown in Table 2 to have a sheet thickness of 1.6 mm or 3.2 mm after final finishing. Resulting steel sheets were used as test specimens after pickling them. The coefficient of heat transfer during cooling was adjusted by regulating the water flow rate during the cooling and the intervals between cooling nozzles. Each of the hot-rolled steel sheets thus produced was subjected to observation of the microstructure by an optical microscope, a tensile test, a bending test, and a Hole Expanding test.

The tensile characteristic was measured using the JIS No. 5 specimen. The Hole Expanding test was made in conformity with the standards of the Japan Iron and Steel Federation by punching a hole of 10 mmϕ through the test specimen (constant clearance of 12.5% ) and enlarging the hole by a conical punch with an apical angle of 60°. Results of these tests are listed in Table 3. For the same steel sheets, the tensile characteristic was also measured without pickling them, but there was found no difference in the tensile characteristic depending on whether the steel sheet was subjected to pickling or not.

Further, uniformity of the mechanical properties was evaluated by taking a total of 15 samples at 3 points in the longitudinal direction of the steel sheet (i.e., a position spaced 15 m from the leading end, a longitudinal middle position, and a position spaced 15 m from the tailing end) and 5 points in the transverse direction (i.e., a transverse middle position, positions spaced 25 mm from both the edges, and positions spaced 100 mm from both the edges), and then measuring the extent of variations in the tensile strength.

As seen from Tables 1 to 3, any of the steel sheets of the Inventive Examples had the structure that the area percentage of bainite was not less than 90% and the mean grain size of bainite was not greater than 3.0 $\mu$m. It was also found that the TS was not less than 780 MPa and the intended characteristic was satisfied. Further, the measured results of the bending workability and the hole expanding ratio were satisfactory. The term "bainite" used herein means such a structure that carbides are mainly precipitated within grains or at the lath boundary, and are less precipitated at the old austenite grain boundary.

Example 2

A steel slab having a composition of C: 0.15 wt %, Si: 0.55 wt %, Mn: 1.8 wt %, P: 0.009 wt %, S: 0.001 wt %, Al: 0.039 wt %, N: 0.0025 wt %, Nb: 0.025 wt %, and Ca: 0.0020 wt % was used as a blank. From this blank, hot-rolled steel sheets (subjected to pickling) having thickness of 3.0–1.2 mm were produced under conditions shown in Table 4. In the case of applying continuous rolling, sheet bars with a thickness of 25 mm obtained by rough rolling were continuously subjected to finish rolling in accordance with the method of heating the tailing end of a preceding sheet and the leading end of a succeeding sheet on the entry side of a finish rolling mill so that the successive sheets were joined together by hot pressing. As with Example 1, the coefficient of heat transfer during cooling was adjusted by regulating the water flow rate during the cooling and the intervals between cooling nozzles. Each of the hot-rolled steel sheets thus produced as test specimen was subjected to the same tests as in Example 1. Obtained results are listed in Table 5.

As seen from Tables 4 and 5, any of the steel sheets of the Inventive Examples had the uniform structure free from grain mixing wherein the area percentage of bainite was not less than 90% (the remaining structure was perlite or martensite) and the mean grain size of bainite was not greater than 3.0 μm. It was also found that the TS was not less than 780 MPa and the measured results of the bending workability and the hole expanding ratio were satisfactory.

The steel sheets of the Inventive Examples had good sheet crown (difference in sheet thickness between a transverse middle position and a position spaced 25 mm from the edge) of not more than 40 μm. Further, small-diameter electric welded pipes were fabricated using the steel sheets of the Inventive Examples and cold-rolled steel sheets (continuously annealed sheets) with a thickness of 1.4 mm. As a result, the electric welded pipe was successfully fabricated from the steel sheets of the Inventive Examples as with the cold-rolled steel sheets without any problems in terms of forming and product characteristics, although an adjustment to the optimum conditions of welding was required in the case using the steel sheets of the Inventive Examples.

According to the invention, as described above, a thin high-strength hot-rolled steel sheet having excellent stretch flangeability can be provided. Also, by properly setting the chemical conditions and the hot rolling conditions, a high-strength hot-rolled steel sheet having a uniform shape and high uniformity of the mechanical properties can be provided. Therefore, the high-strength hot-rolled steel sheet of the invention can be used instead of conventional high-strength cold-rolled steel sheets from the quality point of view. As a result, the invention greatly contributes to, for example, energy saving in the production process and reducing the cost of such products as high-strength members and impact beams (beam pipes) of motor vehicles.

TABLE 1

| Steel | C | Si | Mn | P | S | Al | N | Nb | Ti | Other Components | |
|---|---|---|---|---|---|---|---|---|---|---|---|
| 1 | 0.08 | 0.10 | 2.7 | 0.01 | 0.001 | 0.05 | 0.002 | 0.04 | — | — | Inventive Example |
| 2 | 0.08 | 0.25 | 2.3 | 0.01 | 0.001 | 0.04 | 0.002 | — | 0.08 | Ca/0.0020 | Inventive Example |
| 3 | 0.08 | 0.15 | 2.9 | 0.01 | 0.002 | 0.04 | 0.002 | 0.005 | — | Cr/0.15 | Inventive Example |
| 4 | 0.06 | 0.80 | 2.5 | 0.01 | 0.001 | 0.05 | 0.002 | 0.009 | 0.055 | — | Inventive Example |
| 5 | 0.15 | 0.20 | 1.5 | 0.01 | 0.001 | 0.04 | 0.002 | 0.18 | — | B/0.0015 | Inventive Example |
| 6 | 0.08 | 0.15 | 1.6 | 0.01 | 0.002 | 0.04 | 0.002 | — | — | — | Comparative Example |
| 7 | 0.08 | 0.42 | 2.6 | 0.01 | 0.001 | 0.05 | 0.003 | — | 0.14 | Ca/0.015, Mo/0.02 | Inventive Example |
| 8 | 0.11 | 0.11 | 2.7 | 0.01 | 0.001 | 0.05 | 0.002 | 0.25 | — | — | Comparative Example |
| 9 | 0.08 | 0.02 | 2.2 | 0.01 | 0.001 | 0.04 | 0.002 | — | 0.08 | — | Comparative Example |
| 10 | 0.18 | 0.23 | 1.8 | 0.01 | 0.002 | 0.05 | 0.002 | — | 0.25 | — | Comparative Example |
| 11 | 0.12 | 0.69 | 1.9 | 0.01 | 0.001 | 0.05 | 0.002 | — | 0.18 | Ca/0.0015 | Inventive Example |
| 12 | 0.09 | 0.27 | 1.2 | 0.01 | 0.001 | 0.04 | 0.002 | 0.04 | 0.08 | — | Comparative Example |

TABLE 2

| No. | Steel | Heating Temperature/ ° C. | Application of Continuous Rolling | Finish Rolling Start Temperature/ ° C. | Finish Rolling End Temperature/ ° C. | Thickness of Hot-Rolled Sheet/mm | Cooling After Hot Rolling | Cooling Rate/ ° C./sec. | Sheet Bar Edge Heater | Sheet Bar Heater | Masking in Cooling | Coiling Temperature/° C. |
|---|---|---|---|---|---|---|---|---|---|---|---|---|
| 1 | 1 | 1200 | not applied | 1040 | 840 | 3.2 | continuous cooling*) | 50–100 | used | used | used | 250 |
| 2–8 | 2–8 | 1040 | applied (lubrication in later stage) | 1010 | 840 | 1.6 | continuous cooling*) | 50–100 | used | used | used | 420 |
| 9 | 9 | 1100 | applied (lubrication in later stage) | 1010 | 840 | 3.5 | continuous cooling*) | 50–100 | used | used | used | 420 |
| 10 | 10 | 1250 | applied (lubrication in later stage) | 1010 | 840 | 3.5 | continuous cooling*) | 50–100 | used | used | used | 450 |
| 11 | 11 | 1045 | applied (lubrication in later stage) | 1010 | 840 | 3.5 | continuous cooling*) | 50–100 | used | used | used | 450 |
| 12 | 11 | 1090 | not applied | 920 | 840 | 3.5 | continuous cooling*) | 50–100 | used | used | used | 450 |
| 13 | 11 | 1050 | applied (lubrication in later stage) | 1080 | 840 | 3.5 | continuous cooling*) | 50–100 | used | used | used | 450 |
| 14 | 12 | 1060 | applied (lubrication in later stage) | 1010 | 840 | 3.5 | continuous cooling*) | 50–100 | used | used | used | 450 |

*)Water cooling was started 0.2–1.5 seconds after end of hot rolling and the coefficient of heat transfer in cooling was set to 450–600 $W/m^2 - K$.

TABLE 3

| No. | Mean Grain Size (μm) | Aspect Ratio | Uniformity of Structure (Presence of Grain Mixing) | Microscopic Structure*1) | Yield Stress (Mpa) | Tensile Strength (Mpa) | Elongation (%) |
|---|---|---|---|---|---|---|---|
| 1 | 2.9 | 1.4 | found | B: 10% M: 90% | 815 | 1100 | 8 |
| 2 | 1.8 | 1.3 | not found | B | 950 | 1210 | 13 |
| 3 | 1.7 | 1.4 | not found | B | 890 | 1090 | 15 |
| 4 | 1.7 | 1.2 | not found | B | 893 | 1190 | 13 |
| 5 | 1.6 | 1.4 | not found | B: 95% M: 5% | 820 | 990 | 16 |
| 6 | 5.2 | 2.3 | found | B: 95% M: 5% | 640 | 750 | 13 |
| 7 | 1.3 | 1.4 | not found | B | 870 | 1020 | 19 |
| 8 | 1.3 | 2.2 | found | B | 890 | 1190 | 8 |
| 9 | 2.9 | 1.3 | found | M | 650 | 850 | 13 |
| 10 | 3.5 | 2.5 | found | B: 95% M: 5% | 710 | 910 | 12 |
| 11 | 1.8 | 1.3 | not found | B | 640 | 810 | 24 |
| 12 | 3.4 | 2.5 | found | B | 610 | 740 | 15 |
| 13 | 4.5 | 2.2 | found | B | 645 | 730 | 12 |
| 14 | 3.4 | 1.5 | not found | F: 85% P: 15% | 524 | 680 | 25 |

| No. | Tensile Strength* Elongation (Mpa * %) | Hole expanding ratio (%) | Bending Workability*2 | Uniformity of Mechanical properties*3) | Shape*4) | Remarks |
|---|---|---|---|---|---|---|
| 1 | 8800 | 160 | good | not good | not good | Comparative Example |
| 2 | 15730 | 155 | good | good | good | Inventive Example |
| 3 | 16350 | 165 | good | good | good | Inventive Example |
| 4 | 15470 | 163 | good | good | good | Inventive Example |
| 5 | 15840 | 170 | good | good | good | Inventive Example |
| 6 | 9750 | 120 | fracture | not good | good | Comparative Example |
| 7 | 19380 | 155 | good | good | good | Inventive Example |
| 8 | 9520 | 125 | fracture | not good | not good | Comparative Example |
| 9 | 11050 | 130 | fracture | not good | not good | Comparative Example |
| 10 | 10920 | 120 | fracture | not good | not good | Comparative Example |
| 11 | 19440 | 180 | good | good | good | Inventive Example |
| 12 | 11100 | 125 | fracture | not good | not good | Comparative Example |
| 13 | 8760 | 130 | fracture | not good | not good | Comparative Example |
| 14 | 17000 | 140 | fracture | not good | not good | Comparative Example |

*1)B/bainite, P/perlite, and M/martensite.
*2)Bending workability was determined depending on whether fracture occurred or not by tight bending.
*3)Uniformity of mechanical properties was evaluated to be not good when standard deviation σ of tensile strength TS was not less than 20 MPa for total 15 points on steel sheet, i.e., 3 points in longitudinal direction and 5 points in transverse direction.
*4)Shape was evaluated to be not good when the height of wave exceeded 25 mm.

TABLE 4

| No. | Heating Temperature (° C.) | Application of Continuous Rolling | Finish Rooling Start Temperature (° C.) | Finish Rolling End Temperature (° C.) | Thickness of Hot-Rolled Sheet (mm) | Cooling After Hot Rolling*1) |
|---|---|---|---|---|---|---|
| 1 | 1090 | applied | 1030 | 875 | 2.3 | continuous cooling |
| 2 | 1100 | applied | 1020 | 850 | 2.7 | continuous cooling |
| 3 | 1050 | applied | 1000 | 850 | 1.8 | continuous cooling |
| 4 | 1050 | applied | 1040 | 870 | 2.9 | continuous cooling |
| 5 | 1020 | applied | 990 | 840 | 2.3 | continuous cooling |
| 6 | 1080 | lubrication rolling in later stage stands | 1050 | 860 | 3.2 | continuous cooling |
| 7 | 1110 | not applied | 1040 | 860 | 3.4 | continuous cooling |

TABLE 4-continued

| | | | | | | |
|---|---|---|---|---|---|---|
| 8 | 1100 | applied | 1030 | 860 | 1.8 | later-period cooling |
| 9 | 1100 | not applied | 1000 | 850 | 1.2 | continuous cooling |
| 10 | 1090 | not applied | 910 | 780 | 2.6 | continuous cooling |
| 11 | 1090 | applied | 990 | 850 | 3.5 | continuous cooling |
| 12 | 1080 | applied | 920 | 835 | 2.9 | continuous cooling |
| 13 | 1075 | applied | 980 | 850 | 2.3 | continuous cooling |
| 14 | 1090 | applied | 990 | 850 | 3.1 | continuous cooling |

| No. | Cooling Rate (° C./sec) | Edge Heater | Sheet Bar Heater | Masking in Cooling | Coiling Temperature (° C.) | Remarks |
|---|---|---|---|---|---|---|
| 1 | 90 | used | used | used | 450 | Inventive Example |
| 2 | 75 | used | used | used | 420 | Inventive Example |
| 3 | 80 | used | used | used | 420 | Inventive Example |
| 4 | 60 | used | used | used | 420 | Inventive Example |
| 5 | 80 | used | not used | used | 250 | Comparative Example |
| 6 | 60 | used | used | used | 450 | Inventive Example |
| 7 | 60 | used | used | used | 410 | Inventive Example |
| 8 | 105 | used | used | used | 550 | Comparative Example |
| 9 | 110 | used | not used | used | 650 | Comparative Example |
| 10 | 80 | used | used | used | 310 | Comparative Example |
| 11 | 75 | used | used | used | 150 | Comparative Example |
| 12 | 190 | used | used | used | 450 | Comparative Example |
| 13 | 80 | used | used | not used | 430 | Inventive Example |
| 14 | 15 | used | used | used | 400 | Comparative Example |

*1)Continuous cooling was performed by starting water cooling 0.2–1.5 seconds after end of finish rolling and setting the coefficient of heat transfer in cooling to 45–600 $W/m^2$ – K.
Later-period cooling was performed by starting water cooling within 3 seconds after end of finish rolling and setting the coefficient of heat transfer in cooling to 450–600 $W/m^2$ – K.

TABLE 5

| No. | Mean Grain Size (μm) | Aspect Ratio | Microscopic Structure *1)/ Main Structure | Second Phase Percentage (%) | Yield Stress (Mpa) | Tensile Strength (Mpa) | Elongation (%) | Tensile Strength * Elongation (MPa * %) | Hole expanding ratio (%) | Bending Work-ability | Uniformity of Mechanical properties *2) (Mpa) | Remarks |
|---|---|---|---|---|---|---|---|---|---|---|---|---|
| 1 | 2.1 | 1.4 | B | — | 720 | 850 | 23 | 19550 | 190 | good | 10 | Inventive Example |
| 2 | 1.7 | 1.4 | B | — | 740 | 940 | 20 | 18800 | 180 | good | 8 | Inventive Example |
| 3 | 1.9 | 1.5 | B | M: 7% | 860 | 984 | 20 | 19680 | 170 | good | 11 | Inventive Example |
| 4 | 1.8 | 1.4 | B | — | 780 | 935 | 20 | 18700 | 180 | good | 8 | Inventive Example |
| 5 | 3.4 | 1.5 | M | B: 5% | 895 | 1200 | 7 | 8400 | 130 | fracture | 35 | Comparative Example |
| 6 | 1.8 | 1.4 | B | M: 5% | 920 | 1103 | 15 | 16545 | 135 | good | 10 | Inventive Example |
| 7 | 1.9 | 1.4 | B | — | 870 | 1090 | 15 | 16350 | 140 | good | 12 | Inventive Example |
| 8 | 4.5 | 2.5 | B | P: 17% | 620 | 760 | 10 | 7600 | 125 | fracture | 25 | Comparative Example |
| 9 | 3.2 | 1.3 | F | P: 20% | 550 | 680 | 14 | 9520 | 140 | fracture | 20 | Comparative Example |
| 10 | 5.7 | 2.3 | M | — | 870 | 1085 | 15 | 16275 | 140 | fracture | 35 | Comparative Example |
| 11 | 4.2 | 2.2 | M | — | 810 | 990 | 5 | 4950 | 130 | fracture | 30 | Comparative Example |
| 12 | 4.3 | 2.1 | B | M: 5% | 756 | 865 | 15 | 12975 | 140 | fracture | 20 | Comparative Example |
| 13 | 1.9 | 1.4 | B | M: 5% | 880 | 1040 | 17 | 17680 | 175 | good | 10 | Inventive Example |
| 14 | 5.7 | 2.8 | B | M: 7% | 700 | 880 | 10 | 8800 | 130 | fracture | 25 | Comparative Example |

*1)B/bainite, P/perlite, M/martensite, and F/ferrite.
*2)Tensile test was made for total 15 points on steel sheet, i.e., 3 points in longitudinal direction and 5 points in transverse direction, and standard deviation σ of test results was studied.

What is claimed is:

1. A high-strength hot-rolled steel sheet having excellent stretch flangeability, said steel sheet having a composition containing:

C: about 0.05–0.30 wt %,

Si: about 0.03–1.0 wt %,

Mn: about 1.5–3.5 wt %,

P not more than about 0.02 wt %

S: not more than about 0.005 wt %,

Al: not more than about 0.150 wt %,

N: not more than about 0.0200 wt %, one or both of Nb: about 0.003–0.20 wt % and Ti: about 0.005–0.20 wt %, and the balance consisting of Fe and inevitable impurities, said steel sheet having a microstructure containing fine bainite grains with a mean grain size of not greater than about 3.0 μm at an area percentage of not less than about 90% .

2. A high-strength hot-rolled steel sheet according to claim 1, further comprising B: about 0.0005–0.0040 wt %.

3. A high-strength hot-rolled steel sheet according to claim 1, further comprising: one or more of the following components in a total content of not more than about 1.0 wt %;

Cu: about 0.02–1.0 wt %,

Ni: about 0.02–1.0 wt %,

Cr: about 0.02–1.0 wt %, and

Mo: about 0.02–1.0 wt %.

4. A high-strength hot-rolled steel sheet according to claim 1, further comprising:

Ca: about 0.0005–0.0050 wt %.

5. A high-strength hot-rolled steel sheet according to claim 1, wherein said fine bainite grains have an aspect ratio of not more than about 1.5.

6. A high-strength hot-rolled steel sheet according to claim 1, wherein said fine bainite grains have a maximum size of their major axis not greater than about 10 μm.

7. A method of producing a high-strength hot-rolled steel sheet having excellent stretch flangeability comprising:

preparing-a slab containing C: about 0.05–0.30 wt %, Si: about 0.03–1.0 wt %, Mn: about 1.5–3.5 wt %, P: not more than about 0.02 wt %, S: not more than about 0.005 wt %, Al: not more than about 0.150 wt %, N: not more than about 0.0200 wt %, and one or both of Nb: about 0.003–0.20 wt % and Ti: about 0.005–0.20 wt %;

heating said slab at a temperature of not higher than about 1200° C.;

hot rolling said slab at a finish rolling end temperature of not lower than about 800° C.;

starting to cool a hot-rolled sheet within about two seconds after the end of said rolling step;

continuously cooling said hot-rolled sheet down to a coiling temperature at a cooling rate of about 20–150° C./sec; and coiling said hot-rolled sheet at a temperature of about 300–550° C.

8. A method of producing a high-strength hot-rolled steel sheet according to claim 7, wherein a finish rolling start temperature is in the range of about 950–1050° C.

9. A method of producing a high-strength hot-rolled steel sheet according to claim 7, wherein said coiling temperature is in the range of about 400–550° C.

* * * * *